US008045719B2

(12) United States Patent
Vinton

(10) Patent No.: US 8,045,719 B2
(45) Date of Patent: Oct. 25, 2011

(54) RENDERING CENTER CHANNEL AUDIO

(75) Inventor: Mark Stuart Vinton, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 432 days.

(21) Appl. No.: 12/225,047

(22) PCT Filed: Feb. 23, 2007

(86) PCT No.: PCT/US2007/004904

§ 371 (c)(1),
(2), (4) Date: May 12, 2009

(87) PCT Pub. No.: WO2007/106324

PCT Pub. Date: Sep. 20, 2007

(65) Prior Publication Data

US 2009/0304189 A1 Dec. 10, 2009

Related U.S. Application Data

(60) Provisional application No. 60/782,070, filed on Mar. 13, 2006, provisional application No. 60/782,917, filed on Mar. 15, 2006.

(51) Int. Cl.
*H04R 5/00* (2006.01)

(52) U.S. Cl. ..... 381/27; 381/303

(58) Field of Classification Search ..... 381/27, 381/1, 303, 102, 104

See application file for complete search history.

(56) References Cited

U.S. PATENT DOCUMENTS

| | | | | |
|---|---|---|---|---|
| 5,610,986 | A * | 3/1997 | Miles | 381/27 |
| 6,853,732 | B2 * | 2/2005 | Scofield | 381/27 |
| 6,870,933 | B2 * | 3/2005 | Roovers | 381/27 |
| 7,949,141 | B2 * | 5/2011 | Reilly et al. | 381/63 |
| 2010/0177903 | A1 * | 7/2010 | Vinton et al. | 381/20 |

FOREIGN PATENT DOCUMENTS

| | | | |
|---|---|---|---|
| EP | 0 593 128 | A1 | 10/1993 |
| EP | 0 608 937 | A1 | 1/1994 |
| EP | 1 455 554 | A2 | 2/2004 |
| EP | 1 455 554 | A3 | 2/2004 |
| WO | WO 2007/106324 | | 9/2007 |

OTHER PUBLICATIONS

Notification of Transmittal of the International Search Report and the Written Opinion of the International Searching Authority, PCT/US2007/004904, dated Dec. 7, 2007.

* cited by examiner

*Primary Examiner* — Benjamin Sandvik

(57) ABSTRACT

An audio upmixer, such as a two-channel to three-channel upmixer, employs a difference in a measure of sound at the ears of a listener in accordance with first and second models, one based on a reproduction of the original channels and the other based on a reproduction of the upmixed channels. The difference is minimized while simultaneously causing a, portion of one or more of the stereophonic channels to be applied to the center loudspeaker under some conditions of the signals in the stereophonic channels, the portion being commensurate with the value of a weighting factor, such that the weighting factor controls a balance between two opposing conditions, one in which no signals are applied to the center loudspeaker and another in which no signals are applied to the left and right loudspeakers.

14 Claims, 5 Drawing Sheets

RENDERING CENTER CHANNEL AUDIO

TECHNICAL FIELD

The invention relates to audio signal processing. More specifically, the invention relates to the rendering of three-channel (left, center and right) audio in response to two-channel stereophonic ("stereo") audio. Such arrangements are sometimes referred to as a "two-to-three (2:3) upmixer." Aspects of the invention include apparatus, a method, and a computer program stored on a computer-readable medium for causing a computer to perform the method.

BACKGROUND ART

A "central listener" is one located within an ideal listening area (or "sweet spot"), for example, equidistantly with respect to a pair of stereo loudspeakers. An "off-center" listener is one located outside such an ideal listening area. In a two loudspeaker stereo arrangement, a central listener perceives "phantom" or "virtual" sound images generally at their intended locations between the loudspeakers, whereas an off-center listener perceives such virtual sound images as closer to the loudspeaker with respect to which the listener is nearer. This effect increases as the listener becomes more and more off-center (i.e., the virtual sound images become closer and closer to the nearer loudspeaker).

It is known to take two-channel, left and right, stereo audio signals, and from them derive a central loudspeaker feed derived from a combination of the original signals. In some known systems the combination is variable. Some known systems also vary the gain to the left and right loudspeaker feeds as well. The gains in the various paths typically are controlled by analysis of the directional information contained in the stereo input signals. See, for example, U.S. Pat. No. 4,024,344. The purpose of such center-channel derivations is to counteract the above-mentioned effect for off-center listeners such that sound images, particularly central sound images, are perceived as coming from their intended locations. Unfortunately, an unwanted side-effect of employing such a derived center channel is the degradation (narrowing) of the stereo image for central listeners—sound imaging improvements for off-center listeners cause sound imaging deterioration for central listeners. A central listener does not need a center channel loudspeaker in order to perceive sound images at their intended locations. Thus, there is a need to balance the soundfield improvement for some listeners against the soundfield degradation for others.

DISCLOSURE OF THE INVENTION

In one aspect, the invention provides a method for deriving three channels, a left channel, a center channel, and a right channel from two, left and right, stereophonic channels, by deriving the left channel from a variable proportion of the left stereophonic channel, deriving the right channel from a variable proportion of the right stereophonic channel, and deriving the center channel from the combination of a variable proportion of the left stereophonic channel and a variable proportion of the right stereophonic channel in which each of the variable proportions is determined by applying a gain factor to the left or right stereophonic channel. The gain factors may be derived by determining the difference in a measure of the sound that would be present at the ears of a listener centrally-located with respect to a configuration according to a first model in which the stereophonic channels are applied to left and right loudspeakers and with respect to a configuration according to a second model in which the stereophonic channels are applied to left and right loudspeakers and to a center loudspeaker, and controlling, with gain factors, the proportion of the stereophonic channels applied to the left, center and right loudspeakers in said second model to minimize said difference while simultaneously causing a portion of the left and/or right stereophonic channels to be applied to the center loudspeaker under some conditions of the signals in the two stereophonic channels, the portion being commensurate with the value of a weighting factor, such that the weighting factor controls a balance between two opposing conditions, one in which no signals are applied to the center loudspeaker and another in which no signals are applied to the left and right loudspeakers.

In accordance with aspects of the present invention, a center-channel is derived from a two-channel stereo in such a manner that the improvement in sound imaging for off-center listeners is improved while limiting the sound imaging deterioration for central listeners.

According to aspects of the present invention, improving the off-center listening position experience is achieved by applying a weighted sum of the left and right channel signals to a center channel, wherein the weights are selected in a way that has the effect of trading off the soundfield improvement for some listeners against the soundfield degradation for others.

In one aspect, the present invention provides a new way to calculate the optimum gains when deriving a center channel signal from two-channel stereo signals, indirectly allowing a controllable balancing between the improvement of the perceived soundfield for the off-center listener and the degradation of the perceived soundfield for the central listener that may result from the employment of a center channel.

In an exemplary embodiment, two models of reproduction (Systems 1 and 2) and the results that would be heard by a central listener are considered. System 1 is a conventional pair of loudspeakers receiving the left and right channel signals unchanged. System 2 adds a central loudspeaker receiving a center channel combination of the left and right input channels, with time-variable signal-dependent gains both for that combination and for the left and right channels. With various conditions and simplifications, a measure of the sound that would be heard (the measure being the magnitude or the power, for example) at a central listener's left and right ears for the two systems is calculated. Although it might then be possible to solve a set of equations to set the gains to values that minimize the difference between the two systems, doing so would not be useful—the result would be for the center channel to produce no sound, a trivial solution.

Thus, according to aspects of the invention, a further constraint is introduced—causing a portion of the left and/or right two channel stereophonic input signals to be applied to the center channel under certain conditions. The choice of a weighting or "penalty" factor acts as a balance between two opposing conditions, one in which no signals are applied to the center channel and another in which no signals are applied to the left and right channels. Indirectly, the weighting factor acts as a balance between the improvement for some listeners and the degradation for other listeners. By forcing a controllable amount of the left and/or right two-channel stereophonic input signals to be applied to the center channel under certain signal conditions, the degree of degradation in the soundfield perceived by the central listener is limited while improving the soundfield perceived by off-center listeners.

According to aspects of the invention, soluble equations for the gains are provided that allow increased signal in the central channel, and hence a benefit to off-center listeners, while not unduly impairing the stereo image for a central listener. The trade off or balance between the soundfield improvement for off-center listeners versus the degree of soundfield impairment for central listeners is determined by the choice of a weighting or penalty factor, $\lambda$.

Preferably, all calculations and the actual audio processing are performed on multiple bands, such as critical or narrower than critical bands. Alternatively, if diminished performance is acceptable, calculations and processing may be performed using fewer frequency bands or even on a wideband basis.

It will be noted that the exemplary embodiment of the invention calculates left, center and right channel gains by considering only a measure of sound at the ears of a central listener rather than at the ears of an off-center listener or at the ears of both. An insight of the present invention is that because off-center listeners benefit when the signal in the center channel is increased, it is sufficient to calculate the theoretical degree of impairment for a central listener.

Descriptions below include a three channel rendering method according to aspects of the invention, an overview of the invention, a time/frequency transform that may be employed, a calculation banding structure that may be used, a dynamic smoothing system that may be used, and channel gain calculations that may be employed.

BEST MODE FOR CARRYING OUT THE INVENTION

A goal of the three-channel rendering according to aspects of the present invention is to provide improved virtual sound imaging for off-center located listeners without unduly degrading the listening experience for listeners centrally located. To achieve this goal, in an exemplary embodiment, a method or apparatus practicing the method adaptively selects four gains to control the output channels ($G_L$, $G_R$, $G_{CL}$, $G_{CR}$) per spectral band per time unit (for example, blocks or frames, as described below). Although in the exemplary embodiment a plurality of spectral bands commensurate with the ear's critical bands (or smaller) are employed throughout the frequency range of interest, aspects of the invention may be implemented in simpler, although possibly less effective, embodiments in which fewer spectral bands are employed or in which the method or apparatus operate on a "wideband" basis throughout the frequency range of interest. The adaptation of the gains preferably is based on calculations of the signals at the ears of a listener located in a central listening position, taking into account head-shadowing effects.

In the exemplary embodiment, a method or apparatus practicing the method according to aspects of the invention employs a model with a center loudspeaker such that the resulting signals at the left and right ears of a centrally-located listener are as similar as possible to those resulting from the original stereo signal when reproduced by a model having only left and right loudspeakers while simultaneously forcing, to a controllable degree, some portions of the original stereo signal into a center channel for certain signal conditions. In the exemplary embodiment, such a formulation leads to a least squares equation (in which the controllability is represented by a selectable penalty factor in each band) with a closed form solution for the desired gains.

Figure 1:
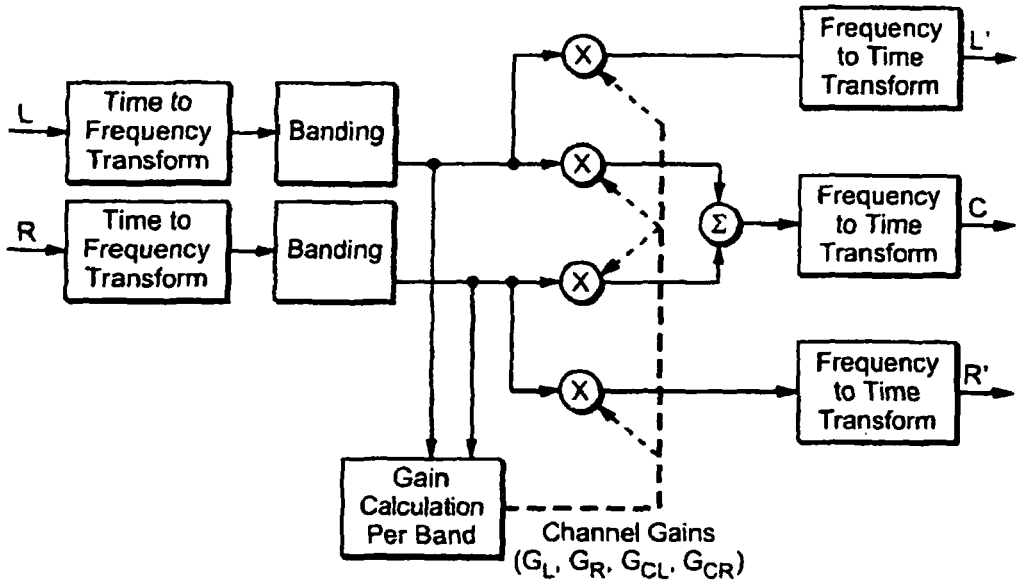
FIG. 1 is a functional block diagram, showing schematically a two channel to three channel up-mixing arrangement according to aspects of the invention.

FIG. 1 shows schematically a high-level functional block diagram of a two to three channel arrangement according to aspects of the invention. The left and right time-domain signals may be divided into time blocks, converted into the spectral domain using a short time Fourier transform (STFT), and grouped into bands. In each band, four gains are computed ($G_L$, $G_R$, $G_{CL}$, $G_{CR}$) and applied to the signals as shown to produce a four-channel output. The output left channel is the original left stereo channel weighted by $G_L$. The output right channel is the original right stereo channel weighted by $G_R$. The output center channel is the sum of the original left and right stereo channels weighted by $G_{CL}$ and $G_{CR}$, respectively. Prior to final signal output an inverse STFT may be applied to each output channel. As will be described below, the employment of four weighting gain factors leads to a calculation employing a four-dimensional expression. Alternatively, the arrangement may be simplified so that the center channel is derived by summing the original left and right stereo channels and applying a single weighting or gain factor to that combination. This results in the employment of three rather than four weighting gain factors and leads to a calculation employing a three-dimensional expression. Although the results may be less satisfactory, if processing complexity is a concern, the three-dimensional alternative may be desirable.

Time/Frequency Transformation

When a filterbank is implemented by a fast Fourier transform ("FFT"), input time-domain signals are segmented into consecutive blocks and are usually processed in overlapping blocks. The FFT's discrete frequency outputs (transform coefficients) are referred to as bins, each having a complex value with real and imaginary parts corresponding, respectively, to in-phase and quadrature components. Contiguous transform bins may be grouped into subbands approximating critical bandwidths of the human ear. Multiple successive time-domain blocks may be grouped into frames, with individual block values averaged or otherwise combined or accumulated across each frame. The weighting gain factors produced according to aspects of the invention may be time smoothed over multiple blocks in order to avoid rapid changes in gain that may cause audible artifacts.

Figure 2:
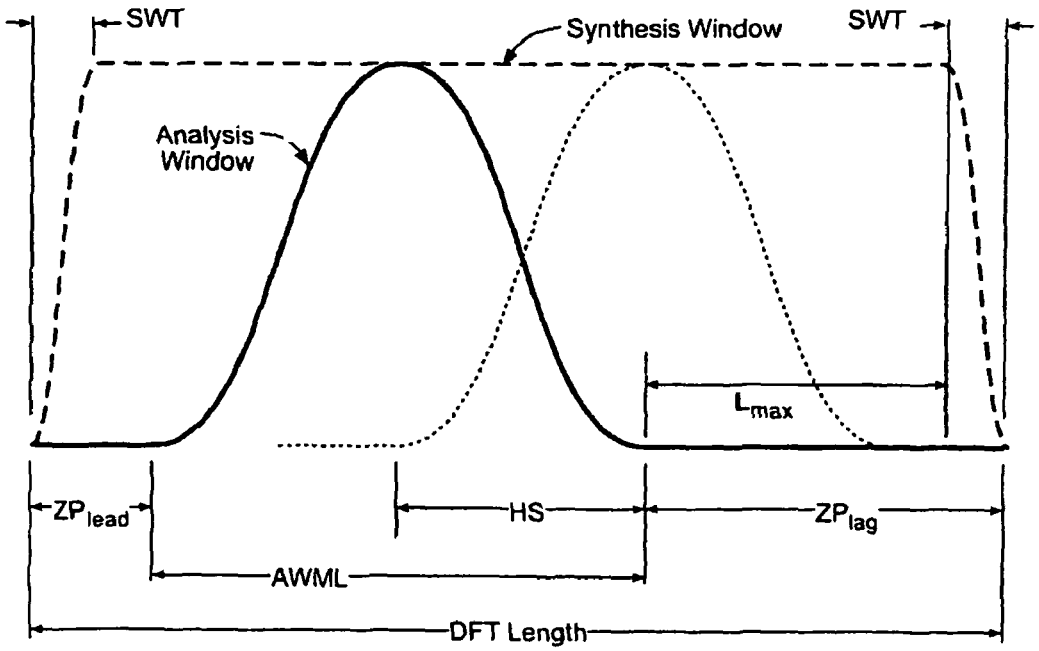
FIG. 2 depicts a suitable analysis/synthesis window pair usable in performing a time to frequency conversion in a practical embodiment of the present invention.

A time/frequency transform that may be used in a three channel rendering system according to aspects of the invention may be based on the well known short time Fourier transform (STFT), also known as the discrete Fourier transform (DFT). To minimize circular convolution effects, the system may use 75% overlap for both analysis and synthesis. With the proper choice of analysis and synthesis windows, an overlapped DFT may be used to minimize audible circular convolution effects, while providing the ability to apply magnitude and phase modifications to the spectrum. FIG. 2 depicts a suitable analysis/synthesis window pair.

The analysis window may be designed so that the sum of the overlapped analysis windows is equal to unity for the chosen overlap spacing. A suitable choice is the square of a Kaiser-Bessel-Derived (KBD) window. With such an analysis window, one may synthesize an analyzed signal perfectly with no synthesis window if no modifications have been made to the overlapping DFTs. However, due to the magnitude and phase alterations applied in such an arrangement the synthesis window should be tapered to prevent audible block discontinuities. Examples of suitable window parameters are listed below.

| | |
|---|---|
| DFT Length: | 2048 |
| Analysis Window Main-Lobe Length (AWML): | 1024 |
| Hop Size (HS): | 512 |
| Leading Zero-Pad ($ZP_{lead}$): | 256 |
| Lagging Zero-Pad ($ZP_{lag}$): | 768 |
| Synthesis Window Taper (SWT): | 128 |

Banding

Figure 3:
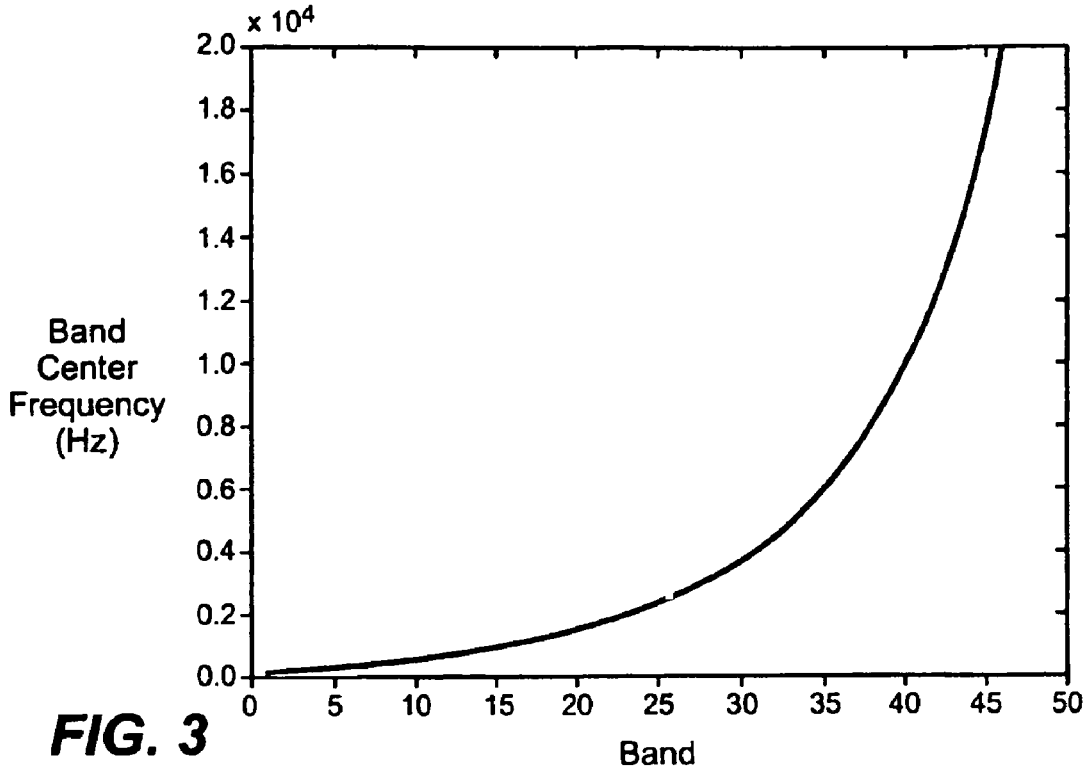
FIG. 3 shows a plot of the center frequency of each band in Hertz for a sample rate of 44100 Hz usable in performing grouping into bands of spectral coefficients in a practical embodiment of the present invention.

Three channel rendering in accordance with aspects of the present invention may compute and apply the gains coefficients in spectral bands with approximately half critical bandwidth. The banding structure may be used by grouping the spectral coefficients within each band and applying the same processing to all the bins in the same group. FIG. 3 shows a plot of the center frequency of each band in Hertz for a sample rate of 44100 Hz, and Table 1 gives the center frequency for each band for a sample rate of 44100 Hz.

TABLE 1

| Band Number | Center Frequency (Hz) |
|---|---|
| 1 | 33 |
| 2 | 65 |
| 3 | 129 |
| 4 | 221 |
| 5 | 289 |
| 6 | 356 |
| 7 | 409 |
| 8 | 488 |
| 9 | 553 |
| 10 | 618 |
| 11 | 684 |
| 12 | 749 |
| 13 | 835 |
| 14 | 922 |
| 15 | 1008 |
| 16 | 1083 |
| 17 | 1203 |
| 18 | 1311 |
| 19 | 1407 |

TABLE 1-continued

| Band Number | Center Frequency (Hz) |
|---|---|
| 20 | 1515 |
| 21 | 1655 |
| 22 | 1794 |
| 23 | 1955 |
| 24 | 2095 |
| 25 | 2288 |
| 26 | 2492 |
| 27 | 2728 |
| 28 | 2985 |
| 29 | 3253 |
| 30 | 3575 |
| 31 | 3939 |
| 32 | 4348 |
| 33 | 4798 |
| 34 | 5301 |
| 35 | 5859 |
| 36 | 6514 |
| 37 | 7190 |
| 38 | 7963 |
| 39 | 8820 |
| 40 | 9807 |
| 41 | 10900 |
| 42 | 12162 |
| 43 | 13616 |
| 44 | 15315 |
| 45 | 17331 |
| 46 | 19957 |

Although a time/frequency transformation as just described is suitable, other time/frequency conversions may be employed. The choice of a particular conversion technique is not critical to the invention.

Signal Adaptive Leaky Integrators

Figure 4:
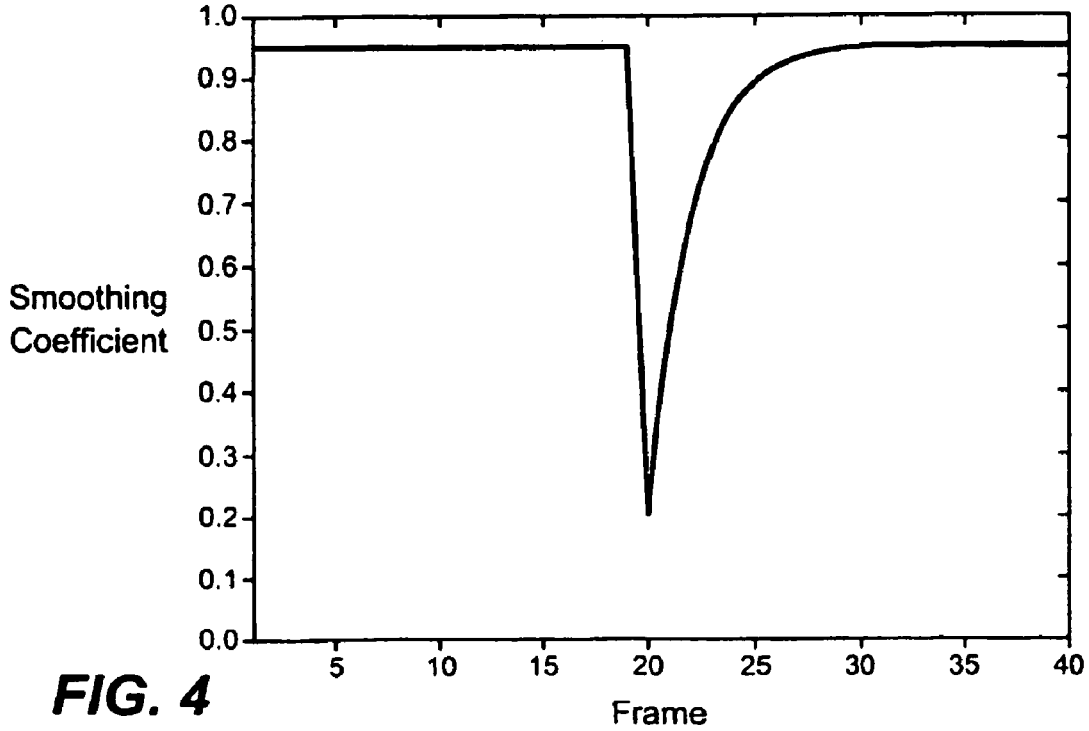
FIG. 4 shows how a parameter in an IIR time smoothing filter employed in a practical embodiment of the invention may vary in time in response to the detection of auditory events in the audio under processing.

In a three channel rendering arrangement according to the present invention, each statistical estimate and variable (see below re "solving for channel gains") may be calculated over a spectral band and then smoothed over time. The temporal smoothing of each variable may be a simple first order IIR filter as expressed in equation 1. However, the alpha parameter in equation 1 may adapt with time. If an audio event is detected, the alpha parameter decreases to a lower value and then builds back up to a higher value over time. A useful technique for detecting audio events (sometimes referred to as "auditory events") is described in B. Crockett, "Improved Transient Pre-Noise Performance of Low Bit Rate Audio Coders Using Time Scaling Synthesis," 117th AES Conference, San Francisco, October 2004, and in published U.S. Patent Application 2004/0165730 of Brett G. Crockett, entitled "Segmenting Audio Signals into Auditory Events." Said AES Paper and published U.S. application are hereby incorporated by reference in their entirety. Thus, the arrangement updates more rapidly as a result of changes in the audio. FIG. 4 shows a typical response of the alpha parameter in a band when an auditory event is detected.

$$C'(n,b)=\alpha C'(n-1,b)+(1-\alpha)C(n,b), \quad (1)$$

where; C(n,b) is the variable computed over a spectral band b at frame n, and C'(n,b) is the variable after temporal smoothing at frame n.

Calculating the Channel Gains

Figure 5:
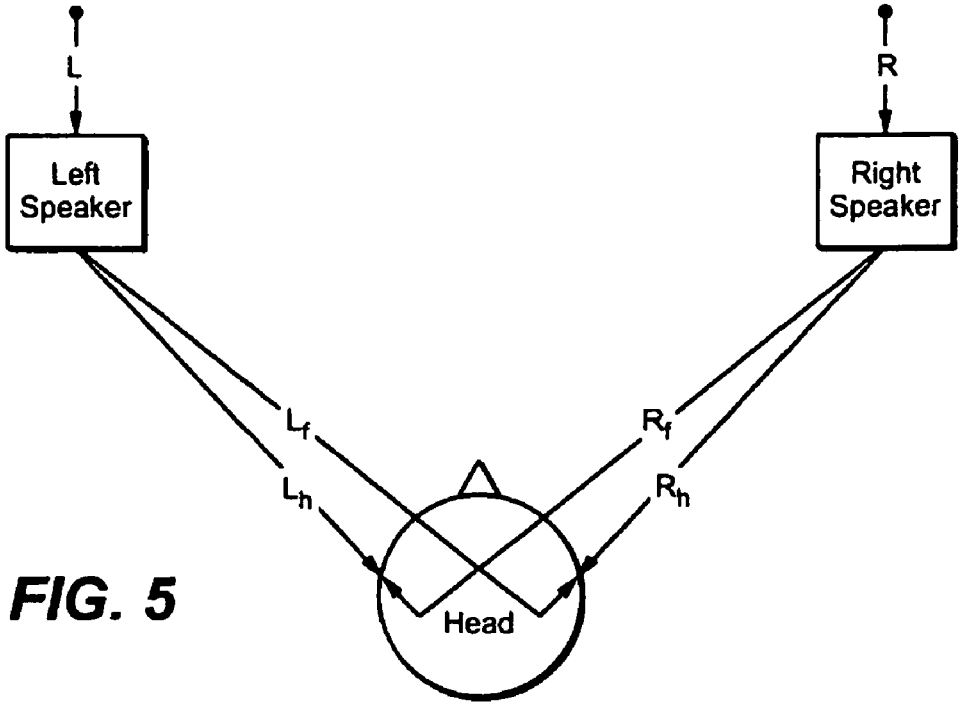
FIG. 5 shows schematically the model of a two-channel reproduction system with the signals from each of the loudspeakers reaching the ears of a centrally-located listener ("System 1").
Figure 6:
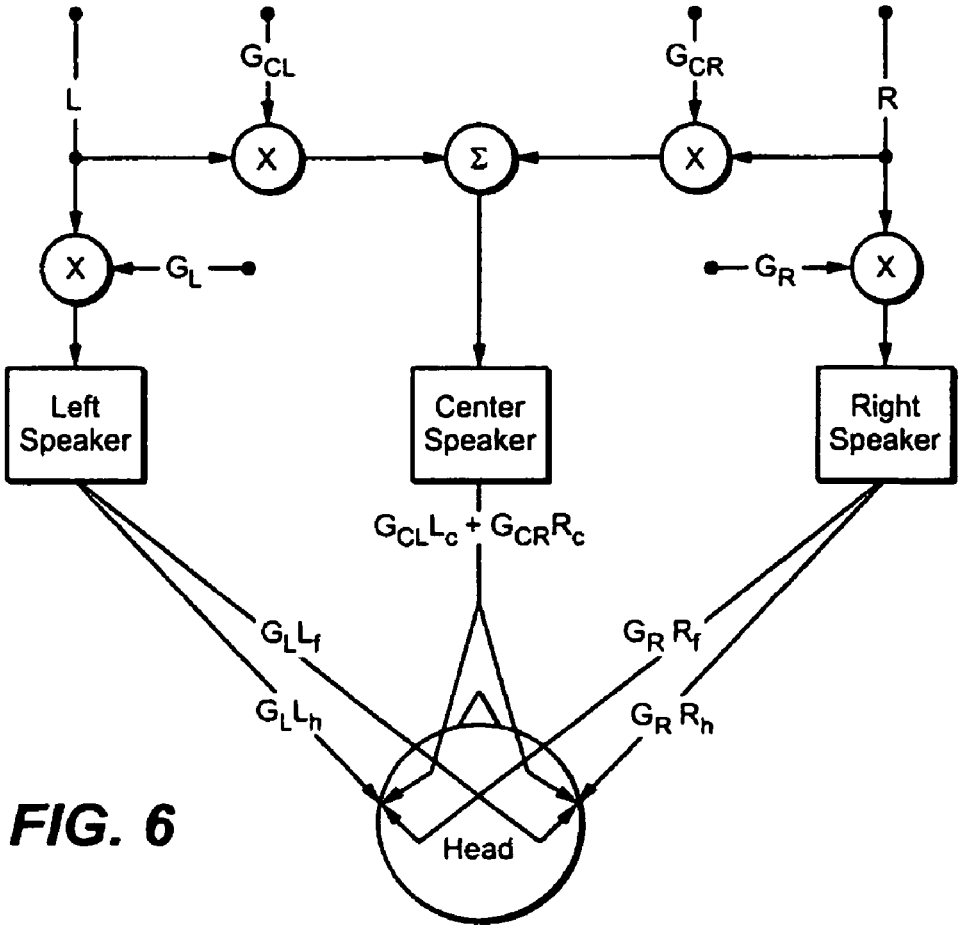
FIG. 6 shows schematically the model of the three-channel reproduction system with the addition of a center channel loudspeaker (System 2).

To solve for the gains in accordance with aspects of the present invention, one may start by constructing a model of the signals at the ears of a listener located in a central listening position for both the original stereo presentation and the new three channel arrangement. It is assumed for both systems that the loudspeakers are reasonably matched, are arranged in the optimal auditioning position and that a listener is in the central listening position. Room impulse responses and speaker transfer functions are not considered in order to avoid a model that is specific to a particular loudspeaker and/or a particular room. FIG. 5 shows schematically the model of a two-channel reproduction system with the signals from each of the speakers reaching the ears of the listener ("System 1"). The signals $L_h$, $L_f$, $R_h$, and $R_f$ are the signals from the left and right speaker through appropriate head-shadow models. Although head related transfer functions (HRTFS) may be employed in the System 1 and System 2 models (the System 2 model is next described), simplifications or approximations of HRTFs, such as head-shadow models may be employed. Suitable head-shadow models may be generated by using the techniques described in "A Structural Model for Binaural Sound Synthesis," by C. Phillip Brown, Richard O. Duda, "IEEE Trans. on Speech and Audio Proc., Vol. 6, No. 5, September 1998, which paper is hereby incorporated by reference in its entirety. The signal at the left ear is the combination of $L_h$ and $R_f$, while the signal at the right ear is the combination of $R_h$ and $L_f$. FIG. 6 shows schematically the model of the three-channel reproduction system with the addition of a center channel (System 2). The original left (L) and right (R) electrical signals are gain adjusted for the left and right loudspeaker and gain adjusted and summed for the center loudspeaker. The processed signals pass to the ear of the listener through the appropriate head-shadow models. The signal at the left ear is assumed to be the combination of $G_L L_h$, $G_R R_f$, $G_{CL} L_c$, and $G_{CR} R_c$, while the signal at the right ear is the combination of $G_R R_h$, $G_L L_f$, $G_{CL} L_c$, and $G_{CR} R_c$. The signals $L_c$ and $R_c$ are the signals from the center speaker through the appropriate head shadow models. Note that the head-shadow model employed is a linear convolution process and hence the gains applied to the L and R electrical signals follow through to the left and right ears.

Once one has a model of the signals at the ears of a listener for both reproduction systems, one may derive a set of equations to solve for the desired gains. This is done by ensuring that the signals at each ear of the listener for both of the systems match as closely as possible while inserting energy into the center loudspeaker of the second system. In order for the two systems to sound the same, both intuitively and mathematically, no energy should be inserted into the center loudspeaker. But this is a trivial solution. In order to produce a useful, non-trivial solution, it is necessary to introduce a penalty such as may be determined by a penalty function that ensures that some energy is introduced into the center. Such a penalty function functions to control a tradeoff between central listener location performance and off-center located listener performance, the trade off being determined empirically by a human or non-human decision maker. The formulation of this problem leads to a closed form solution for the desired gains. The penalty preferably is a function both of the signals in each frequency band and of the penalty factor.

Solving for the Channel Gains

The first step in solving for the gains is to construct the System 1 and System 2 models by deriving the signals that would be present at the ears of a centrally-located listener after head shadowing. Because the exemplary embodiment operates in the spectral domain, the application of the head shadow models can be achieved by multiplication. Hence, one can derive the signals at the outer ear as follows:

$$L_h(m,k)=L(m,k)\cdot H(k) \tag{2}$$

Where: m is the time index, k is the bin index, L(m,k) is the signal from the left speaker, $L_h$(m,k) is the signal from the left speaker at the left ear, and H(k) is the transfer function from the left speaker to the left ear.

$$L_f(m,k)=L(m,k)-F(k) \tag{3}$$

Where: m is the time index, k is the bin index, L(m,k) is the signal from the left speaker, $L_f$(m,k) is the signal from the left speaker at the right ear, and F(k) is the transfer function from the left speaker to the right ear.

$$R_h(m,k)=R(m,k)\cdot H(k) \tag{4}$$

Where: m is the time index, k is the bin index, R(m,k) is the signal from the right speaker, $R_h$(m,k) is the signal from the right speaker at the right ear, and H(k) is the transfer function from the right speaker to the right ear.

$$R_f(m,k)=R(m,k)\cdot F(k) \tag{5}$$

Where: m is the time index, k is the bin index, R(m,k) is the signal from the left speaker, $R_f$(m,k) is the signal from the right speaker at the left ear, and F(k) is the transfer function from the right speaker to the left ear.

$$L_c(m,k)=L(m,k)\cdot C(k) \tag{6}$$

Where: m is the time index, k is the bin index, L(m,k) is the signal derived from the left speaker signal placed in the center speaker, $L_c$(m,k) is the signal from the center speaker at the left ear, and C(k) is the transfer function from the center speaker to the left ear.

$$R_c(m,k)=R(m,k)\cdot C(k) \tag{7}$$

Where: m is the time index, k is the bin index, R(m,k) is the signal derived from the right speaker signal placed in the center speaker, $R_c$(m,k) is the signal from the center speaker at the right ear, and C(k) is the transfer function from the center speaker to the right ear.

In Equations 2-7, the transfer functions H(k), F(k) and C(k) take head-shadowing effects into account. Alternatively, as mentioned above, the transfer functions may be appropriate HRTFs. It is assumed that head is symmetrical, thus making it possible to use the same transfer functions H(k), F(k) and C(k) in equations 2 and 4, 3 and 5, and 6 and 7, respectively.

The next step is to group the spectral samples into bands as discussed above. Furthermore, one may express the spectral groups as column vectors as follows:

$$\vec{L}_h(m,b)=\begin{bmatrix} L_h(m,L_b) \\ L_h(m,L_b+1) \\ \vdots \\ L_h(m,U_b-1) \end{bmatrix}. \tag{8}$$

Where: b is the band index, $L_b$ is the lower bound of band b, and $U_b$ is the upper bound of band b.

$$\vec{L}_f(m,b)=\begin{bmatrix} L_f(m,L_b) \\ L_f(m,L_b+1) \\ \vdots \\ L_f(m,U_b-1) \end{bmatrix} \tag{9}$$

$$\vec{R}_h(m,b)=\begin{bmatrix} R_h(m,L_b) \\ R_h(m,L_b+1) \\ \vdots \\ R_h(m,U_b-1) \end{bmatrix} \tag{10}$$

-continued $$\vec{R}_f(m,b)=\begin{bmatrix} R_f(m,L_b) \\ R_f(m,L_b+1) \\ \vdots \\ R_f(m,U_b-1) \end{bmatrix} \quad (11)$$

$$\vec{L}_c(m,b)=\begin{bmatrix} L_c(m,L_b) \\ L_c(m,L_b+1) \\ \vdots \\ L_c(m,U_b-1) \end{bmatrix} \quad (12)$$

$$\vec{R}_c(m,b)=\begin{bmatrix} R_c(m,L_b) \\ R_c(m,L_b+1) \\ \vdots \\ R_c(m,U_b-1) \end{bmatrix} \quad (13)$$

Using equations 9 through 13, one can now write expressions for the two listening configurations shown, respectively, in FIGS. 5 and 6. The expressions assume that the head shadow signals combine at the ear in a power sense rather than linearly. Thus, phase differences are ignored. Inasmuch as room acoustics and speaker transfer functions have been ignored in order to preserve generality, it is reasonable to assume a power preserving process because it ensures the gains calculated are real positive values only. The minimization problem (between the two listening configurations) is such that there is a closed form expression for the gains once the problem has been solved.

For System 1 the combined signal power at the left ear is assumed to be given by equation 14.

$$X1(m,b)=[|\vec{L}_h(m,b)|^2|\vec{R}_f(m,b)|^2] \quad (14)$$

Where: X1(m,b) is a N by 2 matrix containing the combined signal at the left ear for System 1 for time m and band b. The length (N) of the matrix depends on the length of the band (b) being analyzed.

The combined signal power at the right ear is assumed to be given by equation 15.

$$X2(m,b)=[|\vec{L}_f(m,b)|^2|\vec{R}_a(m,b)|^2] \quad (15)$$

Where: X2(m,b) is a N by 2 matrix containing the combined signal at the right ear for System 1 for time m and band b.

For System 2 the combined signal power at the left ear is assumed to be:

$$\overline{X}1(m,b)=[|\vec{L}_h(m,b)|^2|\vec{R}_f(m,b)|^2|\vec{L}_c(m,b)|^2|\vec{R}_c(m,b)^2] \quad (16)$$

Where: $\overline{X}1$(m,b) is a N by 4 matrix containing the combined signal at the left ear for System 2 for time m and band b. The length (N) of the vector depends on the length of the band being analyzed.

The combined signal power at the right ear is assumed to be:

$$\overline{X}2(m,b)=[|\vec{L}_f(m,b)|^2|\vec{R}_h(m,b)|^2|\vec{L}_c(m,b)|^2|\vec{R}_c(m,b)|^2] \quad (17)$$

Where: $\overline{X}2$(m,b) is a N by 4 matrix containing the combined signal at the left ear for System 2 for time m and band b.

Alternatively, instead of characterizing the signals at each ear in the power domain (i.e., squared), as in Equations 14-17, they may be characterized in the magnitude domain (i.e., not squared).

One can now formulate an equation to minimize the difference between the two systems as follows:

$$M=\min_G\left[E\{(X1\cdot d-\overline{X}1\cdot G)\cdot(X1\cdot d-\overline{X}1\cdot G)^T+(X2\cdot d-\overline{X}2\cdot G)\cdot(X2\cdot d-\overline{X}2\cdot G)^T\}\right]. \quad (18)$$

Where:

$d=[1\ 1]^T$, $G=[G_L G_R G_{CL} G_{CR}]^T$

And

E is the expectation operator

Note: to simplify the notation, the time and band index have been omitted.

The minimization problem given in equation 18 attempts to minimize the difference between the signals assumed to reach the left ear in Systems 1 and 2 and the difference between the signals assumed to reach the right ear in Systems 1 and 2. However, equation 18 has a trivial solution: put no signal in the center speaker (i.e., $G_{CL}=G_{CR}=0$). Hence, one must introduce a penalty function that forces energy into the center speaker. In order to introduce a penalty function one may make the following definitions:

$$X3(m,b)=[|\vec{L}_h(m,b)|^2+|\vec{L}_f(m,b)|^2|\vec{R}_h(m,b)|^2+|\vec{R}_f(m,b)|^2 0\ 0] \quad (19)$$

Where: X3(m,b) is a N by 4 matrix representing the signal energy only from the left and right speakers in System 2 for time m and band b.

$$X4(m,b)=[0\ 0\ |\vec{L}_c(m,b)|^2|\vec{R}_c(m,b)|^2] \quad (20)$$

Where: X4(m,b) is a N by 4 matrix representing the signal energy only from the center speaker in System 2 for time m and band b.

If equations 14-17 employ signal magnitude rather than signal power, then the equations 19 and 20 should also employ magnitude (non-squared) matrix elements.

The penalty function, which represents the difference in energy arriving to the left and right ears in system 2 from the left and right loudspeakers and the center speaker, is given by the following equation:

$$P=E\{\lambda((X3\cdot G)\cdot(X3\cdot G)^T-(X4G)\cdot(X4\cdot G)^T)\} \quad (21)$$

Alternatively, the penalty function may be expressed by the following equation:

$$P=E\{\lambda(-(X4\cdot G)\cdot(X4\cdot G)^T)\} \quad (22)$$

If one modifies equation 18 to include the penalty function one gets the following equation:

$$M=\min_G\left[E\{(d^T\cdot X1\cdot X1\cdot d-2\cdot X1\cdot d\cdot\overline{X}1\cdot G+G^T\cdot\overline{X}1\cdot\overline{X}1^T\cdot G+d^T X2\cdot X2^T\cdot d-2\cdot X2\cdot d\cdot\overline{X}2\cdot G+G^T\cdot\overline{X2}\cdot\overline{X2}^T\cdot G+\lambda G^T\cdot X3\cdot X3^T\cdot G-\lambda G^T\cdot X4\cdot X4^T\cdot G)\right] \quad (23)$$

Where: λ represents a trade off between the difference in the two systems and the expense of putting no energy in center. The penalty factor λ may have a value between 0 and infinity (although practical values are likely to be between 0 and 1) and may have a different value for each frequency band or groups of frequency bands. If the penalty function portion of the equation is minimized with respect to the gain factors, the center channel gain factors would be infinite. If the non-penalty function of the equation is minimized, the center channel gain factors would be zero. The penalty factor thus permits a selectable amount of non-zero center channel gains. As the penalty factor λ increases, the minimum center channel gains depart more and more from zero for some conditions of the signals in the two stereophonic input channels. As λ decreases in value, the width of the center image increases. Intuitively, the λ parameter provides a trade off between the sweet-spot listening performance and the non-sweet-spot listening performance. The factor may be determined empirically by a human or non-human decision maker, for example, the reproduction system's designer. The decision may employ criteria deemed suitable by the system designer. Some or all of the decision criteria may be subjective. Different decision makers may select different values of λ. A practical device practicing aspects of the present invention, for example, may have different values of λ for different modes of operation. For example, a device may have a "music" mode and a "movie" mode. The movie mode might have larger lambda values, resulting in a narrower center image (thus helping to anchor the movie dialog to the desired central position). Rather than residing in a device, choices for the penalty factor λ may be carried with entertainment software so that when played in a suitable device, the software creator's choices for λ are implemented during playback of the software. In a practical embodiment a value of 0.08 for λ has been found to be usable.

One can now solve the minimization problem as follows:

$$M = \min_{G}\left[E\{(d^T \cdot X1 \cdot X1 \cdot d - 2 \cdot X1 \cdot d \cdot \overline{X}1 \cdot G + G^T \cdot \overline{X}1 \cdot \overline{X}1^T \cdot G + d^T X2 \cdot X2^T \cdot d - 2 \cdot X2 \cdot d \cdot \overline{X}2 \cdot G + G^T \cdot \overline{X2} \cdot \overline{X2}^T \cdot G + \lambda G^T \cdot X3 \cdot X3^T \cdot G - \lambda G^T \cdot X4 \cdot X4^T \cdot G\}\right] \quad (24)$$

Because the expectation operator is linear, one may make the following definitions to simplify the notation:

$$R_{xx1} = E\{X1^T \cdot \overline{X}1\} \quad (25)$$

Where: $R_{xx1}$ is a 2 by 4 matrix $$R_{xx2} = E\{X2^T \cdot \overline{X}2\} \quad (26)$$

Where: $R_{xx2}$ is a 2 by 4 matrix $$V_{x1} = E\{\overline{X}1^T \cdot \overline{X}1\} \quad (27)$$

Where: $V_{x1}$ is a 4 by 4 matrix $$V_{x2} = E\{\overline{X}2^T \cdot \overline{X}2\} \quad (28)$$

Where: $V_{x2}$ is a 4 by 4 matrix $$V_{x3} = \lambda \cdot E\{X3^T \cdot X3\} \quad (29)$$

Where: $V_{x3}$ is a 4 by 4 matrix $$V_{x4} = \lambda \cdot E\{X4^T \cdot X4\} \quad (30)$$

Where: $V_{x4}$ is a 4 by 4 matrix

For equations 25 through 30, the expectation operator (E) is emulated using the signal adaptive leaky integrator described above. Substituting equations 25 through 30 into equation 24 one gets:

$$M = \min_{G}[d^T \cdot E\{X1 \cdot X1^T\} \cdot d - 2d^T \cdot R_{xx1} \cdot G + G^T \cdot V_{x1} \cdot G + d^T \cdot E\{X2 \cdot X2^T\} \cdot d - 2d^T \cdot R_{xx2} \cdot G + G^T \cdot V_{x2} \cdot G + G^T \cdot V_{x3} \cdot G - G^T \cdot V_{x4} \cdot G]. \quad (31)$$

Figure 7:
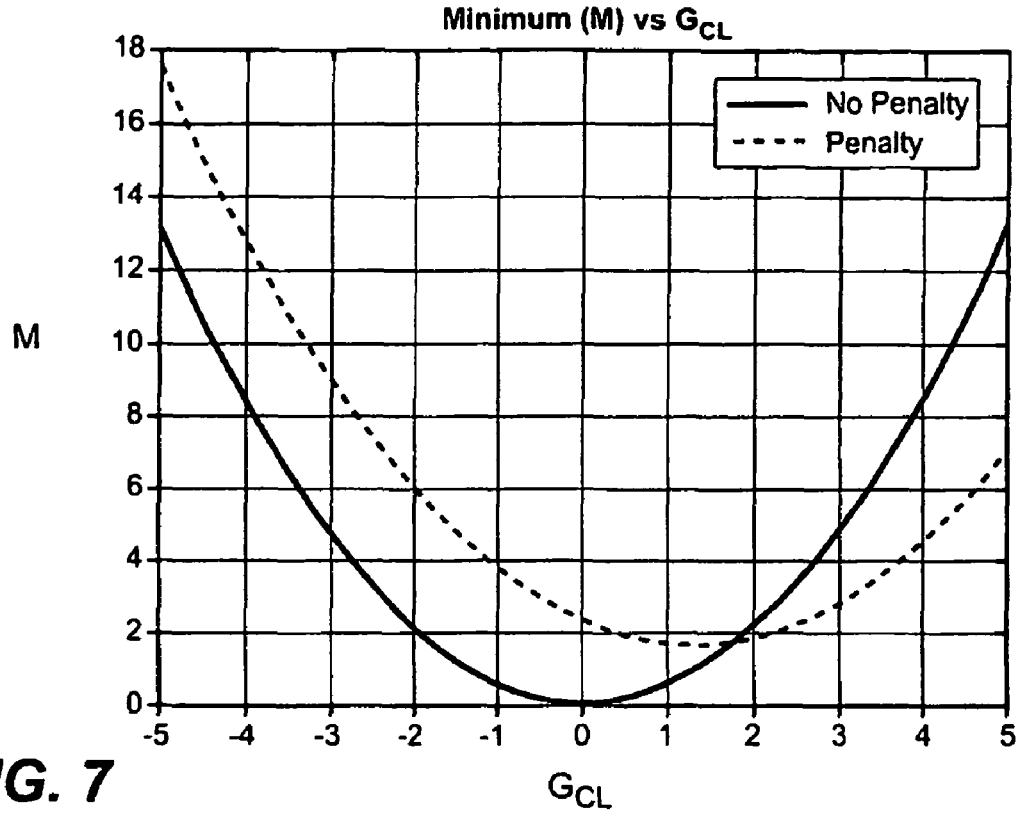
FIG. 7 shows the effect of plotting the expression to be minimized from equation 31 with respect to the center gain factor $G_{CL}$ both with and without the penalty function.

To show the operation of the penalty function for a particular arbitrarily chosen signal condition, one can set all of the desired gains to the optimal value and then vary one of the center gains both with and without the penalty function. If one then plots the expression to be minimized from equation 31 with respect to one of the center channel gain factors, such as $G_{CL}$, both with and without the penalty function, one should observe that the penalty function shifts the minima for the gain factor $G_{CL}$ away from zero on the x-axis; hence ensuring that some signal is applied to the center channel. FIG. 7 shows the effect of plotting the expression to be minimized from equation 31 with respect to the center gain factor $G_{CL}$ both with and without the penalty function. As expected the minima is shifted off the x-axis.

Setting the partial derivative with respect to G to zero one gets equation 30

$$-2dR_{xx1} + 2V_{x1}G - 2dR_{xx2} + 2V_{x2}G + 2V_{x3}G - 2V_{x4}G = 0 \quad (32)$$

Hence, the solution for the least squares equation is given by:

$$G = \frac{dR_{xx1} + dR_{xx2}}{V_{x1} + V_{x2} + V_{x3} - V_{x4}} \quad (33)$$

As equation 33 requires the inversion of a 4 by 4 matrix, it is important to check the rank of the matrix prior to inversion. There are signal conditions that may cause the matrix to be non-invertible (rank is less than four). However, these cases are simple to fix by adding a small amount of noise to the signals prior to calculations.

The gains calculated in equation 33 are then normalized such that the sum of the powers of all the output signals is equal to the sum of the power of the input signals. Finally the gains may be smoothed (over one or more blocks or frames) using the signal adaptive leaky integrators described above prior to application to the signal as shown in FIG. 1.

Although minimization is calculated in the above example, other known techniques for minimization may be employed. For example, a recursive technique, such as a gradient search, may be employed.

Figure 8:
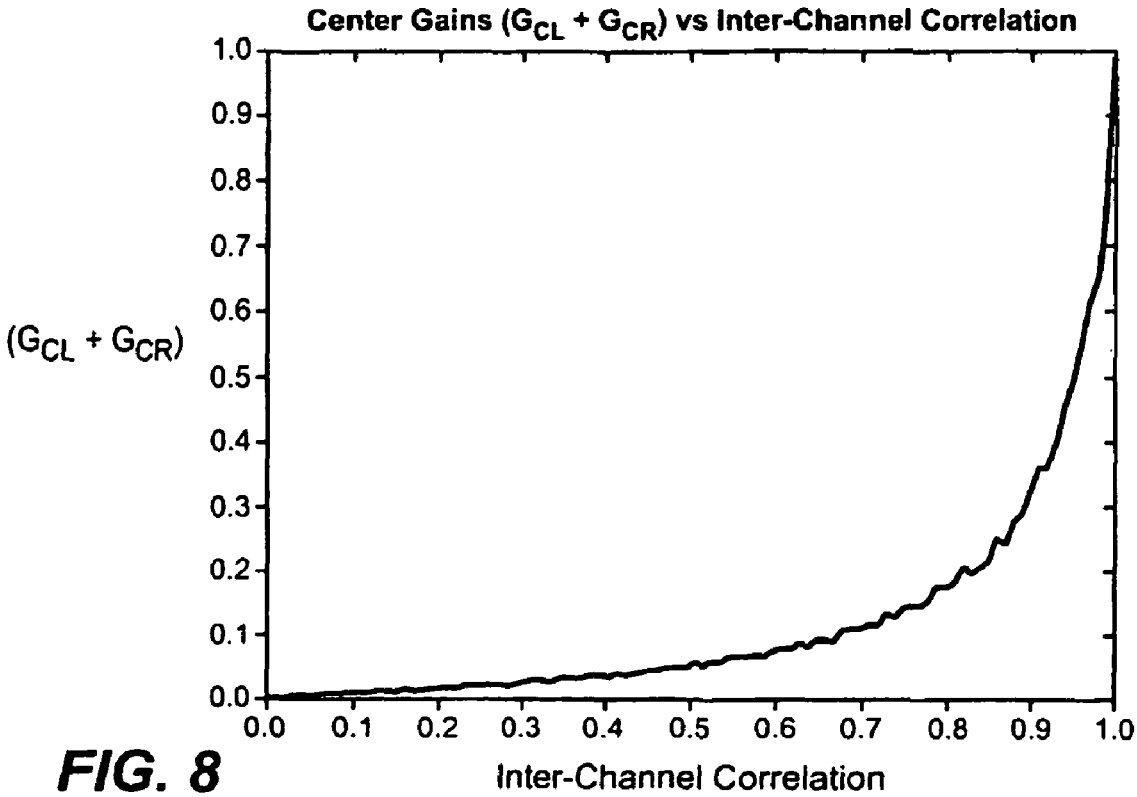
FIG. 8 shows a plot of the sum of the center channel gains versus correlation between the left and right input signals.

Performance of the invention under varying signal conditions may be demonstrated by applying to the arrangement of FIG. 1 left and right input test signals with equal energy and by varying the interchannel correlation between those test signals from 0 (completely uncorrelated) to 1 (completely correlated). Suitable test signals are, for example, white noise signals in which the signals are independent for the case of no correlation and in which the same white noise signal is applied for the case of full correlation. As the interchannel correlation is progressively changed from no correlation to full correlation, the desired output changes from left and right images only (no correlation) to a center image only (full correlation). Thus, one would expect the sum of the resulting center channel gains to be close to zero when the interchannel correlation is low and the sum of the center channel gains to be close to 1 when the interchannel correlation is high. FIG. 8 shows a plot of the sum of the center channel gains versus interchannel correlation. The sum of the gains varies as expected as the interchannel correlation varies.

Figure 9:
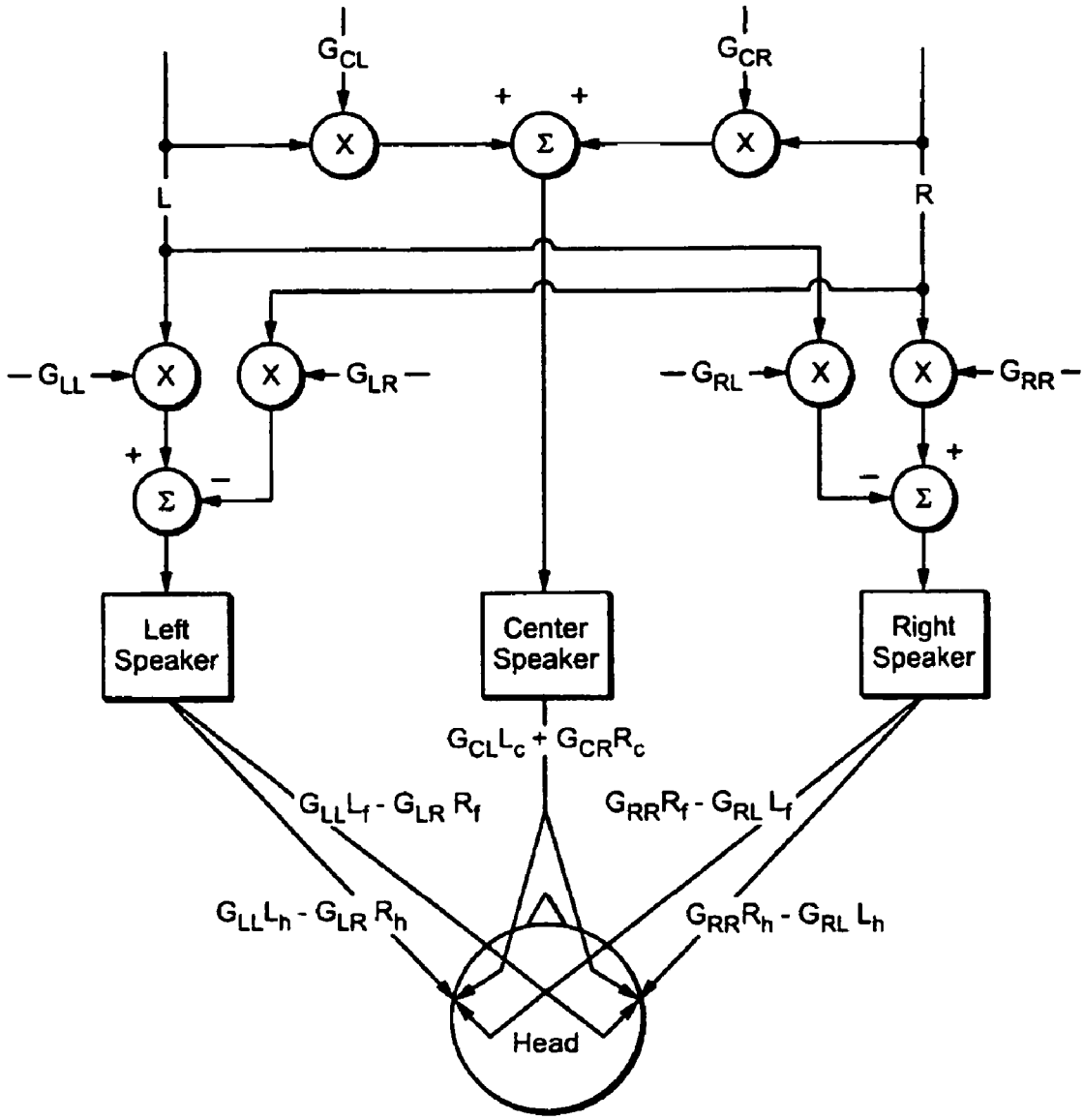
FIG. 9 shows schematically the model of the three-channel reproduction system with the addition of a center channel loudspeaker and the introduction of crosstalk into the left and right channels (variation of System 2).

According to aspects of the invention described so far, output left and right signals are created from variable proportions of the original input left and right stereophonic signals, respectively. Although this works well, in some applications it may be advantageous to construct the output left and right signals from variable proportions of both the original left and the original right signals. As is well known in the art, the opposite audio channel (right into left and left into right) may be inserted 180° out of phase to broaden the perceived front soundstage. Thus, aspects of the present invention may also include the creation of each of the output left and right signals from both the original left and original right stereophonic signals as shown schematically in FIG. 9. In FIG. 9 the output left signal is the combination of the original left signal multiplied by the variable $G_{LL}$ and the original right signal multiplied by the variable $-G_{LR}$. Likewise the output right signal is the combination of the original right signal multiplied by the variable $G_{RR}$ and the original left signal multiplied by the variable $-G_{RL}$. Hence the signal at the left ear of the listener is now assumed to be the combination of $G_{LL}L_h$, $-G_{LR}R_h$, $G_{RR}R_f$, $-G_{RL}L_f$, $G_{CL}L_c$, and $G_{CR}R_c$. Similarly the signal at the right ear is assumed be the combination of $G_{RR}R_h$, $-G_{RL}L_h$, $G_{LL}L_f$, $-G_{LR}R_f$, $G_{CL}L_c$, and $G_{CR}R_c$.

In order to solve for the new gain in the system depicted in FIG. 9, equation 16 is extended to equation 34.

$$\overline{X}1(m,b)=[|\overline{L}_h(m,b)|^2|\overline{R}_h(m,b)|^2|\overline{R}_f(m,b)|^2|\overline{L}_f(m,b)|^2|\overline{L}_c(m,b)|^2|\overline{R}_c(m,b)|^2], \quad (34)$$

Where: $\overline{X}1(m,b)$ is a N by 6 matrix containing the combined signal at the left ear for system 2 for time m and band b. The length (N) of the vector depends on the length of the band being analyzed.

Equation 17 is extended to equation 35.

$$\overline{X}2(m,b)=[|\overline{L}_f(m,b)|^2|\overline{R}_f(m,b)|^2|\overline{R}_h(m,b)|^2|\overline{L}_h(m,b)|^2|\overline{L}_c(m,b)|^2|\overline{R}_c(m,b)|^2], \quad (35)$$

Where: $\overline{X}2(m,b)$ is a N by 6 matrix containing the combined signal at the left ear for system 2 for time m and band b.

One also needs to modify the gain vector shown in equation 18 to incorporate the new gains as shown in equation 36.

$$G=[G_{LL}-G_{LR}G_{RR}-G_{RL}G_{CL}G_{CR}]^T \quad (36)$$

Finally, equations 19 and 20 are modified as shown in equations 37 and 38 respectively.

$$\overline{X}3(m,b)=[|\overline{L}_h(m,b)|^2|\overline{L}_f(m,b)|^2|\overline{R}_h(m,b)|^2|\overline{R}_f(m,b)|^2|\overline{L}_h(m,b)|^2|\overline{L}_f(m,b)|^2|\overline{R}_h(m,b)|^2+|\overline{R}_f(m,b)|^2\ 0\ 0] \quad (37)$$

Where: X3(m,b) is a N by 6 matrix representing the signal energy from the left and right speakers in system 2 for time-m and band b.

$$X4(m,b)=[0\ 0\ 0\ 0\ |\overline{L}_g(m,b)|^2|\overline{R}_g(m,b)|^2], \quad (38)$$

Where: X4(m,b) is a N by 6 matrix representing the signal energy from the center speaker in system 2 for time m and band b.

One can now solve for the new gain vector given in equation 36 using the same equation shown in equation 24 inserting the modified equations given above.

Implementation

The invention may be implemented in hardware or software, or a combination of both (e.g., programmable logic arrays). Unless otherwise specified, any algorithms included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion. Each such program may be implemented in any desired computer language (including machine, assembly, or high level procedural, logical, or object oriented programming languages) to communicate with a computer system. In any case, the language may be a compiled or interpreted language.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a computer-readable storage medium, configured with a computer program, where the storage medium so configured causes a computer system to operate in a specific and predefined manner to perform the functions described herein.

A number of embodiments of the invention have been described. Nevertheless, it will be understood that various modifications may be made without departing from the spirit and scope of the invention. For example, some of the steps described herein may be order independent, and thus can be performed in an order different from that described.

The invention claimed is:

1. A method for deriving three channels, a left channel, a center channel, and a right channel from two, left and right, stereophonic channels, comprising deriving the left channel from a variable proportion of the left stereophonic channel, deriving the right channel from a variable proportion of the right stereophonic channel, and deriving the center channel from the combination of a variable proportion of the left stereophonic channel and a variable proportion of the right stereophonic channel, wherein each of said variable proportions is determined by applying a gain factor to the left or right stereophonic channel, the gain factors being derived by determining the difference in a measure of the sound that would be present at the ears of a listener centrally-located with respect to a configuration according to a first model in which the stereophonic channels are applied to left and right loudspeakers and with respect to a configuration according to a second model in which the stereophonic channels are applied to left and right loudspeakers and to a center loudspeaker, and controlling, with gain factors, the proportion of the stereophonic channels applied to the left, center and right loudspeakers in said second model to minimize said difference while simultaneously causing a portion of the left and/or right stereophonic channels to be applied to the center loudspeaker under some conditions of the signals in the two stereophonic channels, the portion being commensurate with the value of a weighting factor, such that the weighting factor controls a balance between two opposing conditions, one in which no signals are applied to the center loudspeaker and another in which no signals are applied to the left and right loudspeakers.

2. A method according to claim 1 wherein in said deriving the center channel, the variable proportion of the left stereophonic channel and the variable proportion of the right stereophonic channel are equal, whereby the center channel may be derived with the use of one gain factor rather than two and a total of three gain factors are employed.

3. A method according to claim 1 wherein in said deriving the center channel, the variable proportion of the left stereophonic channel and the variable proportion of the right stereophonic channel are not constrained to be equal, whereby the center channel derivation requires the use of two gain factors and a total of four gain factors are employed.

4. A method according to any one of claims 1-3 wherein said controlling includes performing a mathematical minimization of an expression having a penalty function in which said weighting factor is a penalty factor.

5. A method according to claim 1 wherein the measure of sound is the magnitude of the sound pressure.

6. A method according to claim 1 wherein the measure of sound is the power of the sound pressure.

7. A method according to claim 1 wherein determining the difference in a measure of the sound that would be present at the ears of a listener includes the performance of a calculation that takes into account head-shadowing effects.

8. The method according to claim 1 wherein said determining and said controlling employ calculations performed in the frequency domain.

9. The method according to claim 8 wherein said calculations performed in the frequency domain are performed in a multiplicity of frequency bands commensurate with or smaller than critical bands.

10. The method according to claim 1 wherein controlling the amount of the two-channel stereophonic signals applied to the left, center and right loudspeakers channels includes solving a least-squares equation having a closed-form solution for the amount of each of said two-channel stereophonic signals applied to the left, center, and right loudspeakers.

11. The method of claim 1 further comprising deriving the left channel from a variable proportion of the right stereophonic channel, and deriving the right channel from a variable proportion of the left stereophonic channel.

12. The method of claim 11 wherein the right stereophonic channel from which the left channel is derived is an out-of-phase version of the right stereophonic channel and the left stereophonic channel from which the right channel is derived is an out-of-phase version of the left stereophonic channel.

13. Apparatus adapted to perform the methods of any one of claims 1 through 4 and 5 through 12.

14. A computer program, stored on a computer-readable medium for causing a computer to perform the methods of any one of claims 1 through 4 and 5 through 12.

* * * * *